United States Patent [19]

Boals

[11] Patent Number: 5,060,630

[45] Date of Patent: Oct. 29, 1991

[54] VALVE SEAT FOR AUTOMATIC CONTROL SYSTEM FOR WATER HEATERS

[76] Inventor: Wayne S. Boals, P.O. Box 1289, Blue Jay, Calif. 92317

[21] Appl. No.: 641,377

[22] Filed: Jan. 15, 1991

[51] Int. Cl.[5] ..... F24H 1/00

[52] U.S. Cl. ..... 126/362; 137/513.5; 137/334; 137/510; 137/495

[58] Field of Search ..... 126/362, 361, 373; 137/513.5, 334, 495, 491, 510, 560

[56] References Cited

U.S. PATENT DOCUMENTS

| | | | |
|---|---|---|---|
| 1,148,568 | 8/1915 | Bees | 137/510 |
| 3,754,563 | 8/1973 | Boals | 126/362 |
| 4,607,615 | 8/1986 | Boals | 137/560 |
| 4,694,651 | 9/1987 | Yardley et al. | 137/513.5 |

*Primary Examiner*—James C. Yeung

*Attorney, Agent, or Firm*—Nilsson, Robbins, Dalgarn, Berliner, Carson & Wurst

[57] ABSTRACT

A control valve for limiting the passage of water between a water source and a hot water tank within an automatic control system for water heaters. The control valve contains a sensing means for determining pressure differentials between the hot water tank, the water source and the delivery system. A rod is secured within the control valve housing for limiting the movement of the sensing means when the hot water heater ruptures of leaks. The sensing means also includes a valve seat which acts to control the entrance of water from the water source into the hot water tank. The valve seat defines a leak path which prevents water pressure loss in the hot water tank during a water cooling cycle.

4 Claims, 2 Drawing Sheets

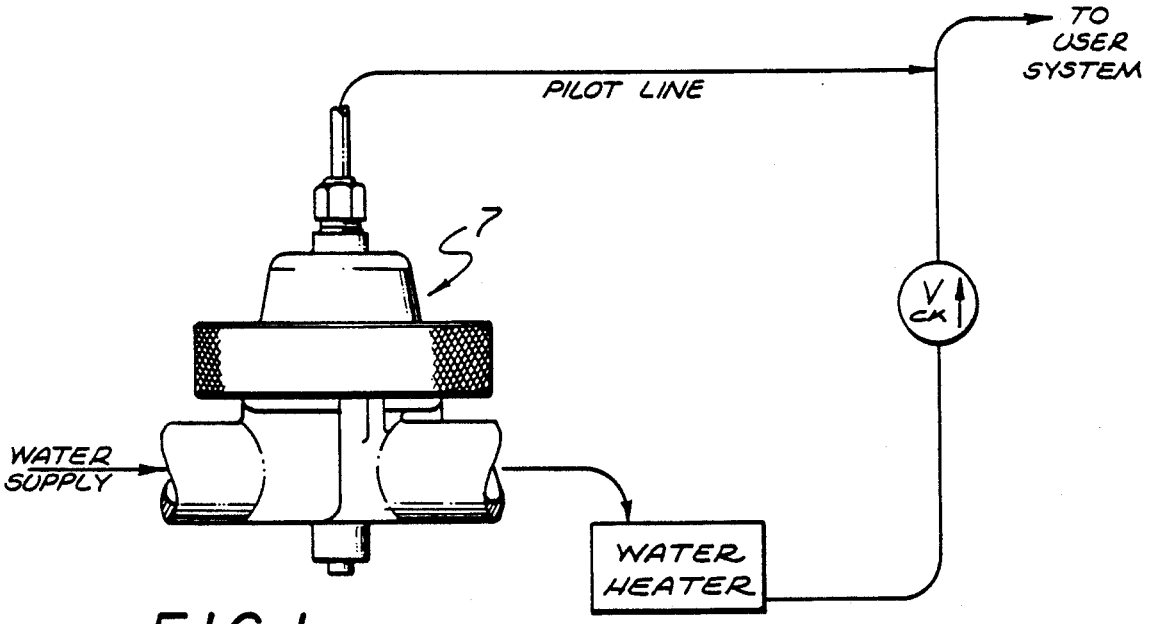
FIG. 1
FIG. 2
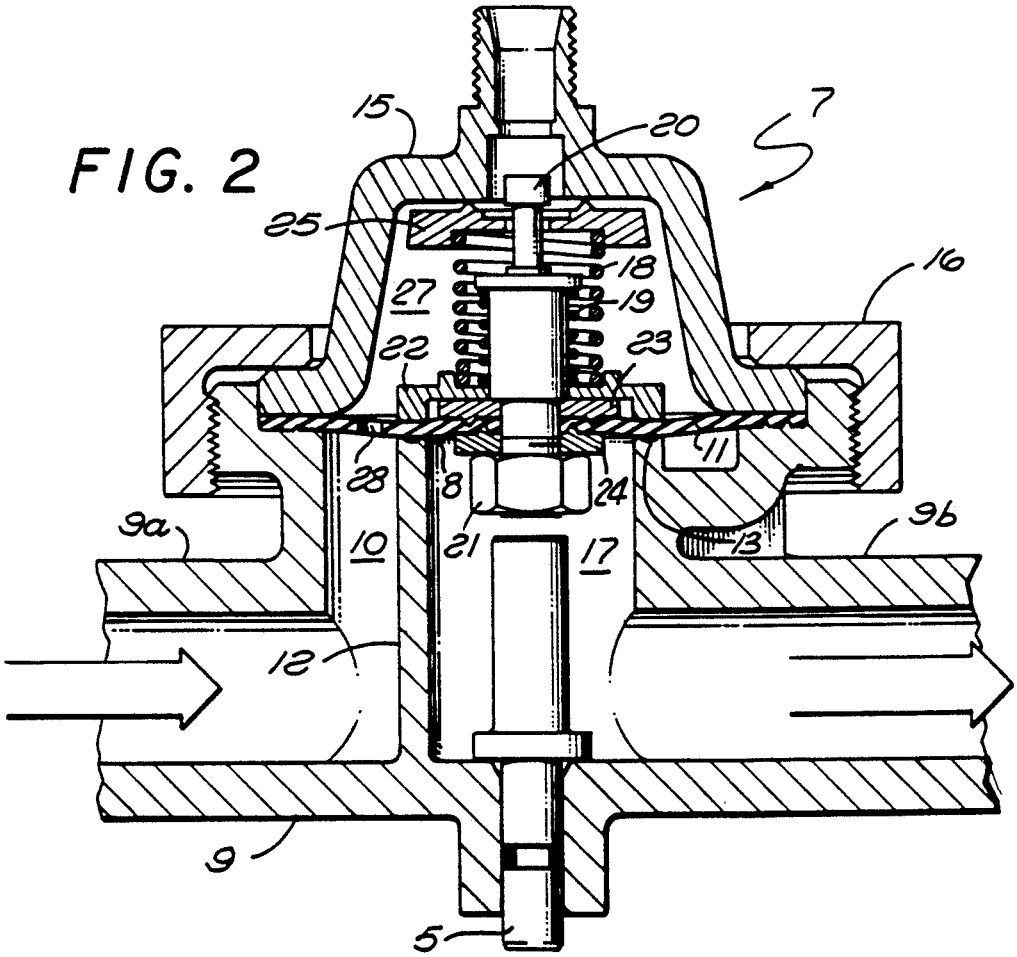

VALVE SEAT FOR AUTOMATIC CONTROL SYSTEM FOR WATER HEATERS

FIELD OF THE INVENTION

The present invention relates generally to isolating a pressurized hot water tank from a pressurized water source system, and, more specifically, to a control valve for limiting the passage of water between the water source and the hot water tank. The system includes means for sensing the pressure differential between the hot water tank, the water source and the delivery system to activate the control valve. A rod is incorporated within the control valve for limiting the movement of the sensing means when the hot water heater ruptures or leaks. The present invention also is more particularly directed to an improved valve seat defining a leak path. The valve seat is an integral part of the sensing means and acts to control the entrance of water from the pressurized water source into the hot water tank. The leak path, defined by the valve seat, prevents water pressure loss in the hot water tank during a water cooling cycle.

BACKGROUND OF THE INVENTION

Hot water heaters are commonly used to supply hot water to household users. Generally, a hot water tank is connected to a pressurized water source. The water in the storage tank is heated by a source of energy, such as natural gas or electricity.

Hot water heaters operate with little or no maintenance. However, the mineral content of the water stored in a water heater can corrode and weaken the structure of the storage tank causing a leak or rupture. Excessive pressure in the storage tank caused by extreme water temperatures can also cause a rupture.

To minimize damage from water leakage, the prior art discloses several systems for isolating the water source from the storage tank when a rupture occurs. U.S. Pat No. 3,063,432 discloses a can beneath the water heater that collects water in the event of a leak. The collected water activates a circuit causing the water and fuel supplies to be cut off.

Other patents, such as U.S. Pat No. 2,724,401, disclose similar apparatus, but have not been economically practical. U.S. Pat No. 3,754,563 to Wayne S. Boals discloses an improved design describing a valve to control the flow between the water source and the storage tank. While the disclosed design works quite well, the apparatus includes numerous seals which could deteriorate under certain operating conditions. Further, the apparatus does not provide for a means of providing cold water to the water tank when the water achieves excessive temperatures and is discharged by a temperature-pressure relief valve.

Consequently, U.S. Pat No. 4,607,615 to Wayne S. Boals discloses an improved automatic control system for water heaters. The apparatus includes a diaphragm between a chamber measuring the pressure of the storage tank and a chamber measuring the pressure of the user system. The diaphragm reacts to differential pressure between the water source, the storage tank and the user system. When a leak or rupture occurs, the pressure from the storage tank drops to ambient pressure. The pressure from the user system is then higher than the pressure from the storage tank. This causes a stem to urge the diaphragm against a valve seat and prevents water from flowing from the cold water source into the storage tank. The Boals U.S. Pat. No. 4,607,615 does not provide a means to limit the extent the stem would move the diaphragm into the chamber measuring the pressure of storage tank. Nor does the Boals U.S. Pat. No. 4,607,615 patent provide a means to reset the diaphragm, and hence the control valve, once the leak or rupture is fixed.

The apparatus disclosed by Boals further prevents a water pressure loss occurring in the storage tank during a cooling cycle through a leak path in a valve seat. Due to manufacturing limitations, however, the leak path could not be made small enough to obtain the desired minimum flow rate into the storage tank under all conditions. The present invention is an improvement of the structure disclosed in the Boals U.S. Pat. No. 4,607,615.

SUMMARY OF THE INVENTION

An improvement on a automatic control system for water heaters including a leak path to allow the passage of water between a water source system and a hot water tank to prevent loss of water pressure during a water cooling cycle, and a means to limit the extent unequal pressure between the hot water tank and the user system may urge a diaphragm into a chamber, while providing a means to reset the diaphragm and hence the control valve once the leak or rupture is fixed.

BRIEF DESCRIPTION OF THE DRAWINGS

FIG. 1 is a schematic diagram of a system using a control valve constructed in accordance with the present invention;

FIG. 2 is a schematic view, in cross section, of one embodiment of the present invention illustrating the control valve in a closed position;

DETAILED DESCRIPTION

Figure 3:
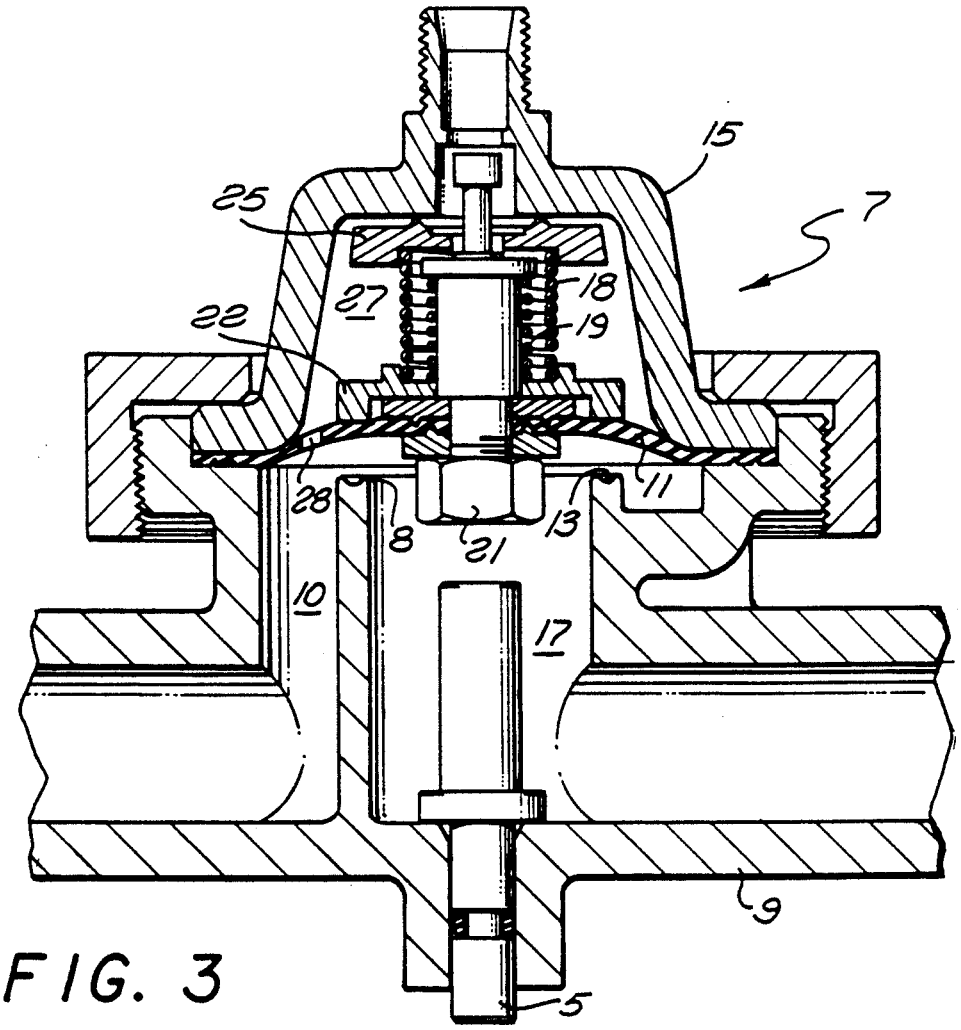
FIG. 3 is a schematic view of the structure shown in FIG. 1 illustrating the control valve in a open position.

The present invention is an improvement of a control valve contained within an automatic control system for water heaters. When the pressure in the storage tank drops to ambient pressure due to a leak or rupture, a control valve isolates the cold water source from the storage tank by forcing the diaphragm against the valve seat, thus closing the entrance of the storage tank. At the same time, a check prevents hot water in the user system from entering the tank. Thus, when a hot water faucet is opened, only a minimum flow will occur which notifies the user that a leak has occurred. The prior art, however, does not provide a means to limit the extent the diaphragm was forced against the valve seat and thus the entrance to the storage tank. Nor does the prior art provide a means to reset the diaphragm to its open state when the leak or rupture is fixed.

The present invention provides a means, within the entrance to the storage tank, to limit the extent a stem or poppet may urge the diaphragm against the valve seat. Further, the present invention provides a reset means to release the diaphragm from the valve seat when the storage tank is capable of storing water. As stated above, when the leak or rupture occurs, the supply pressure acts to force the diaphragm against the valve seat. The present invention allows the user to manually supply a counter pressure to release the diaphragm from the valve seat and open the entrance to the storage tank if such is desired.

A second problem with the prior art system occurs when the water in the storage tank cools. As the hot water in the storage tank cools, the pressure of the water decreases. Ultimately the pressure in the storage tank will be reduced to zero. The prior art, U.S. Pat. No. 3,754,563, control system would then isolate the water source from the storage tank and erroneously signal the user that a leak or rupture has occurred. The present invention prevents water pressure loss in a hot water tank during a cooling cycle while allowing a loss in pressure in the storage tank to signal a leak or rupture. In the prior art U.S. Pat. No. 4,607,615, issued to Wayne S. Boals, the apparatus disclosed a valve seat which also prevents water pressure loss during a cooling cycle. However, due to manufacturing limitations, the leak path disclosed in the prior art could not be made small enough to obtain the desired minimum flow rate into the storage tank under all conditions.

The present invention solves the minimum flow rate problem by utilizing the circumference of the valve seat. Instead of a small notch across the width of the valve seat, as disclosed in the Boals U.S. Pat. No. 4,607,615 patent, which directly connects the water source to the storage tank, the present invention decreases the flow rate of the leak path by increasing the leak path length. The present invention recognizes that in a typical hydraulic flow path, the cross sectional flow rate is inversely proportional to the length of the flow path. Thus, lengthening the flow path reduces the flow rate. In the present invention, by utilizing the longest path possible between the water source and the tank, i.e. the circular body of the valve seat, the leak path length, as compared to the Boals U.S. Pat. No. 4,607,615 structure, can be increased by a factor of about 22 to 1 for the same size valve. The flow rate is proportionally decreased. This allows the leak path flow rate to meet the desired minimum rate necessary to replace water volume loss.

The overall system within which the present invention operates is fully and adequately disclosed in the Boals U.S. Pat. No. 4,607,615 which is hereby incorporated by reference. Therefore, the following description will be directed more specifically to the control valve and the valve seat configuration containing the unique leak path.

FIG. 1 shows a control valve operating in conjunction with a complete water heater system. Water from a water supply enters a water heater through a control valve 7. The outlet of the water heater is connected to a check valve. The water flows from the water heater through the check valve to the user system. The check valve communicates with the control valve through a pilot line. When a leak or rupture occurs, the check valve prevents water from entering the domestic system. In turn, the communication through the pilot line informs the control valve 7 to prevent water from entering into the water heater from the water source, thus limiting water loss.

FIG. 2 shows a control valve 7 having a valve seat constructed in accordance with the present invention with a diaphragm 11 closed. The control valve 7 includes a housing 9 having a housing inlet 9*a* which is connected to a source of water under pressure and which defines a fluid source chamber 10 and a housing outlet 9*b* which is connected to the hot water heater a storage tank (not shown) and which defines an exit chamber 17. The control valve 7 includes a diaphragm 11 secured at its inner portion by cooperating teeth in the opposed washers 23 and 24 and at its outer perimeter by teeth formed in the housing 9 and a cover 15. Cover 15 and the housing 9 are secured together by a cap 16 which is threaded upon the housing portion 9. A stem 20 engages a seat 25, a guide 22, the washers 23 and 24 and a nut 21. The nut 21 is threadably attached to the stem 20 to secure the washer 24 to the stem 20.

The diaphragm 11 and the cover 15 define a chamber 27. Water from the source chamber 10 fills chamber 27 via an orifice 28 in the diaphragm 11. The guide 22 is spring loaded with spring 18 to urge the guide 22 against the washer 23, the diaphragm 11 and a valve seat 8. The seat 25 secures spring 18 against the cover 15. When the system is first installed, the pressured water from the cold water source contained in chamber 10 will be equal to the pressure in chamber 27 via the orifice 28. The differential between the chambers when user demand occurs moves the diaphragm 11 away from the valve seat 8 against the force of the spring 18. The housing 9 also includes the valve seat 8 formed by a rib 12. The rib 12 surrounds exit chamber 17. The diaphragm 11 acts to close exit chamber 17. When the storage tank is full and the household user's faucet is closed, the pressure in chamber 27, reflecting the user system pressure, is equal to the pressure in exit chamber 17 from the storage tank. When this occurs, the force of spring 18 urges the guide 22 against the washer 23 and thus the diaphragm 11 is engaged with the valve seat 8.

As shall be understood more fully upon reading the detailed description of FIG. 3, the valve seat 8 incorporates an orifice 13 of unique design for preventing the loss of pressure during a cooling cycle. This unique design utilizes the circumference of valve seat 8, rather than the width of the valve seat 8, to minimize the fluid flow into exit chamber 17 while the diaphragm 11 is forced against the valve seat.

When a leak or a rupture occurs, the pressure in exit chamber 17 drops to ambient while the pressure in chamber 27 remains equal to supply pressure in source chamber 10. The pressure differential forces the stem 20 into exit chamber 17. This urges the diaphragm 11 against the valve seat 8 and the orifice 13, preventing the passage of water between chamber 27 and exit chamber 17 and into the storage tank. The control valve 7 includes a rod 5 at the base of exit chamber 17. When a pressure differential between chambers 27 and 17 forces the stem 20 into exit chamber 17 against the force of a spring 19, the rod 5 limits the extent the stem 20 may be pushed into exit chamber 17. The stem 20 may only move into exit chamber 17 until the nut 21 engages the rod 5.

As a means of repressurizing the storage tank after a simulated leak has occurred, the rod 5, in conjunction with spring 19, may be used to counter the pressure from chamber 27. The user may open a hot water faucet and manually push against the bottom of the rod 5 causing the top of the rod 5 to push against the nut 21 and hence the stem 20. This will force the diaphragm 11 away from the valve seat 8 and allow water to enter the storage tank.

FIG. 3 shows the present invention with the diaphragm away from the valve seat. The unique design of the orifice 13 contained within the valve seat 8 prevents clogging that would occur in a conventional small orifice. When the user system needs additional water, the pressure from the user system will be less than the pressure from the fluid source, and the diaphragm 11 is forced away from the valve seat 8. At this point the orifice 13 is "washed" by the cold water flow across the valve seat 8. The cold water flows from the water source, into exit chamber 17 and ultimately into the storage tank.

Figure 4:
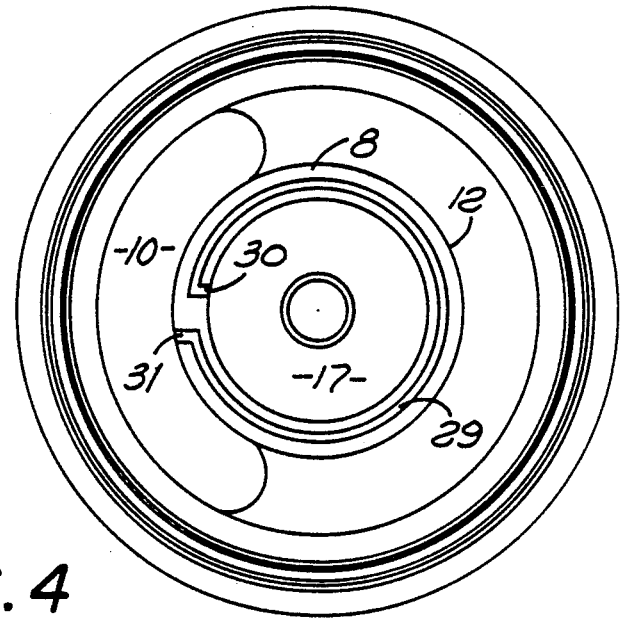
FIG. 4 is a top view of one embodiment of the valve seat illustrating the orifice in greater detail.

FIG. 4 shows a view of the top of the housing with the cap-diaphragm assembly removed. This view shows details of the valve seat 8 including the improved leak path in the form of the orifice 13. The rib 12 separating fluid source chamber 10 form the exit chamber 17 forms the valve seat 8, which in turn defines the orifice 13. The orifice 13 includes an entrance notch 31 from the fluid source chamber 10. The orifice 13 also includes an exit notch 30 into exit chamber 17 that is radially angularly displaced relative to the entrance notch 31. Finally, the orifice 13 includes a groove 29 for fluid communication between the entrance notch 31 and the exit notch 30. When the diaphragm 11 is forced against the valve seat 8 by the force of the spring 18 (as shown in FIG. 1), it is desirable for a small amount of water to enter the storage tank to allow for the recovery of water volume lost during a cooling cycle. This prevents the storage tank pressure from dropping to zero. The orifice 13 provides for the make up of water volume loss at a low rate by allowing water to enter into the orifice 13 from fluid source chamber 10 through the entrance notch 31. The water then travels the length of the groove 29 between diaphragm 11 and valve seat 8 and into exit chamber 17 through the exit notch 30.

The length and cross section of the groove 29 determines the water flow rate into exit chamber 17. Thus, the water flow rate into the pressure chamber can be decreased or increased by lengthening or shortening the groove 29 and by increasing or decreasing its cross section. The slowest water flow rate is obtained by utilizing the entire circumference of the valve seat 8 for a given cross sectional area of the groove 29.

What is claimed is:

1. In a water heater having a pressurized fluid source, a storage tank, and a delivery system supplied from the storage tank wherein a control valve, including a housing defining a valve seat, a rib and a pressure chamber, allows the passage of fluid from the fluid source to the storage tank by sensing a pressure differential between pressure at the fluid source and the pressure at the delivery system to move a diaphragm away from the valve seat, said valve seat defining a leak path for preventing water pressure loss in said water heater during a cooling cycle, the improvement comprising:

said valve seat having, a first circumference defining an entrance notch from the pressurized fluid source;

a second circumference defining an exit notch into the pressure chamber, said entrance and exit notches being radially angularly displaced relative to each other; and means defined by said valve seat for providing a fluid communication path between said entrance notch and said exit notch; and said diaphragm engaging said valve seat when the pressure across said diaphragm is substantially zero while allowing water to flow through said fluid communication path during a water heater cooling cycle and wherein said diaphragm enters said fluid communication path to prevent fluid communication between said entrance notch and said exit notch when a leak or rupture occurs in said storage tank.

2. The improvement as claimed in claim 1 wherein said valve seat defines a common wall between said entrance and exit notches.

3. The improvement as defined in claim 2 which further includes rod means disposed within said housing for limiting movement of said diaphragm in a closing direction.

4. The improvement as defined in claim 3 wherein said rod means is slidably disposed within said housing and extends externally thereof for manual manipulation for movement of said diaphragm away from said valve seat.

* * * * *